United States Patent [19]

Sandgren et al.

[11] 4,374,870

[45] Feb. 22, 1983

[54] METHOD OF IMPREGNATING A CABLE

[75] Inventors: Kurt K. Sandgren, Grödinge; Hans V. L. Selving, Skärholmen, both of Sweden

[73] Assignee: Telefonaktiebolaget L M Ericsson, Stockholm, Sweden

[21] Appl. No.: 13,979

[22] Filed: Feb. 22, 1979

Related U.S. Application Data

[63] Continuation of Ser. No. 812,567, Jul. 5, 1977, abandoned, which is a continuation of Ser. No. 674,612, Apr. 7, 1976, abandoned, which is a continuation of Ser. No. 496,032, Apr. 9, 1974, abandoned.

[30] Foreign Application Priority Data

Sep. 14, 1973 [SE] Sweden ..... 73125643

[51] Int. Cl.[3] ..... B05D 5/12

[52] U.S. Cl. ..... 427/120; 427/434.2; 427/434.4; 427/434.5; 427/434.6; 427/434.7; 427/435; 427/443

[58] Field of Search ..... 156/48, 51; 118/405, 118/420, 428; 174/23 R, 23 C; 427/120, 434 R, 435, 443, 434 A, 434 B, 434 C, 434 DE, 434.2, 434.4, 434.5, 434.6, 434.7

[56] References Cited

U.S. PATENT DOCUMENTS 2,390,823 12/1945 Bennett ..... 118/405
3,854,444 12/1974 Franke et al. ..... 156/48

FOREIGN PATENT DOCUMENTS 143842 of 0000 Colombia .
721711 1/1955 United Kingdom .
1354788 5/1974 United Kingdom .

*Primary Examiner*—Michael R. Lusignan
*Assistant Examiner*—Richard Bueker

[57] ABSTRACT

A method of impregnating a cable with a water impenetrable and water repellent sealing material comprising passing the cable axially through a pipe having open ends such that the pipe and cable form an annular gap along the length of the pipe. The gap is relatively thin compared to the diameter of the cable. A heated flowable sealing material is injected under pressure into the gap at an intermediate position between the open ends of the pipe so that the sealing material will flow inwardly into the cable during passage thereof through the pipe while the excess material travels axially along the cable in the gap and freely flows axially outwards from the ends of the pipe for collection and recirculation. The solidified filling material forms a solid barrier protecting the cable against penetration of water.

7 Claims, 9 Drawing Figures

METHOD OF IMPREGNATING A CABLE

This is a continuation of application Ser. No. 812,567 filed July 5, 1977 (now abandoned) which, in turn, is a continuation application based on Ser. No. 674,612 filed Apr. 7, 1976 (now abandoned) which, in turn, is a continuation application based on Ser. No. 496,032 filed Aug. 9, 1974 (now abandoned).

BACKGROUND OF THE INVENTION

The present invention relates to a method of impregnating a cable.

The purpose of the invention is to make possible filling of multiple cables in the form of core conductors or layer cables in one step, in most of the known and used methods, the core conductors are filled in two turns, namely the first in connection with cabling of small core conductors and the second in connection with cabling of small core conductors to thicker cables. Layer cables are filled according to known methods in such a manner that during the cabling of conductors or conductor pairs filling material is supplied in several steps with the beginning in the cable core or the first layer and after that during the supply of every new layer of conductors or conductor pairs.

In accordance with the invention inconveniences and risks of accidents will decrease and thereby fouling of both machines, machine drums and floors may be avoided entirely. Another advantage of the invention is that the same cable machine may be used for different cable types without cleaning, namely for both paper isolated as well as for filled or non-filled plastic isolated cable.

A further advantage is that expensive and bulky cooling equipment for filling material can be eliminated as leaking problems no longer exist.

BRIEF DESCRIPTION OF THE DRAWING

The invention will be described more in detail in connection with the enclosed drawings where.

DETAILED DESCRIPTION

Figure 1:
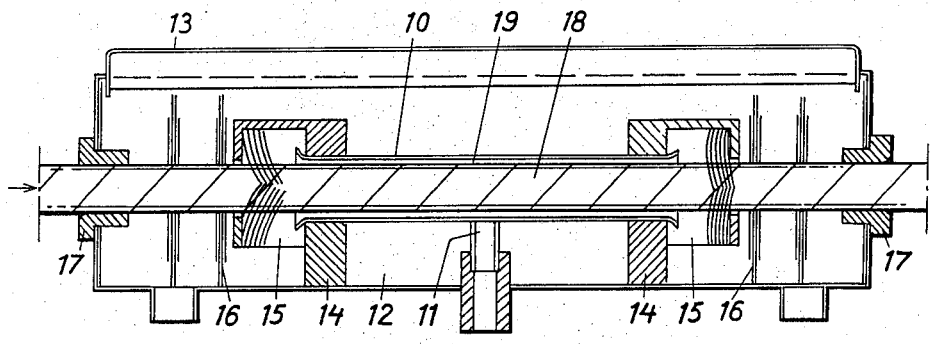
FIG. 1 shows an apparatus for carrying out the method according to the invention.

The arrangement according to FIG. 1 comprises a filling pipe 10 with open ends and an inlet 11 for filling material at a distance from the ends. More exactly, the inlet is placed halfway between the ends. The filling pipe is placed in a box 12 provided with a lid 13 and two holders 14 for the pipe 10, which box is arranged for receiving and discharging excess filling material. The holders 14 also constitute holding means for draining chambers 15 connected to the ends of the filling pipe 10 which draining chambers, together with splash aprons 16 placed outside them and caulkings 17 existing in the walls of the box in openings for the entry exit passages of a cable 18, are arranged to draw-off and catch excess filling material.

The schematically described apparatus is used in the following manner. The finished cable 18 is conveyed through the filling pipe 10 which along its whole length together with the cable 18 forms a thin annular gap 19 which is open at its ends. At the same time the filling material is heated and supplied in flowable form to the inlet 11, the filling material being heated to such temperature and conveyed at such pressure that the filling material via the annular gap 19 is pressed into the inner space of the cable so that after the cooling of the filling material in the cable 18 a solid barrier against penetration of water is obtained. The cable 18 which is fed into the apparatus comprises a plurality of conductors having a band wound thereon which permits passage of the filling material under pressure in one direction but because of capillary action prevents outward passage of the material in the opposite direction.

It has been found suitable to heat the filling material to a temperature which exceeds the temperature at which the filling material becomes flowable by at least 5° C. and most 15° C. Microcrystalline petroleum waxes, mixtures of microcrystalline petroleum waxes and oils, for example vaseline, polyether with low molecular weight and high melting index, and mixtures of microcrystalline petroleum waxes, vaseline, polyisobutylene and aluminum stearate can be used as the filling material. The gap 19, via which the heated filling material, for example vaseline is pressed into the cable 18, is suitably given an extent in the radial direction which is at least 1 mm and most 3 mm, i.e. the minor diameter of the pipe 10 exceeds the diameter of the cable 18 by at least 2 mm and most 6 mm.

Figure 2:
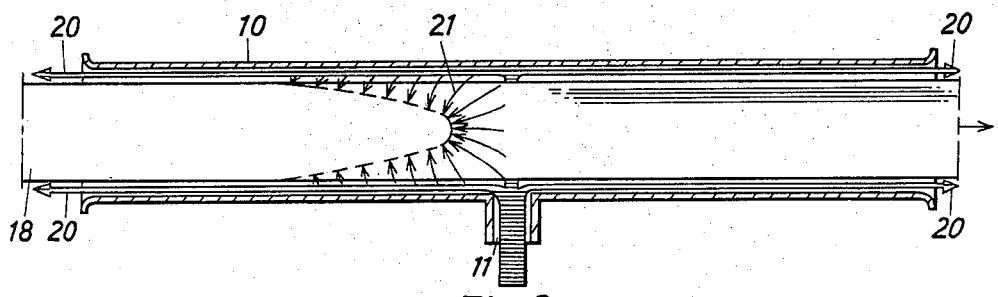
FIG. 2 shows the flow distribution of the filling material in the apparatus according to FIG. 1, FIGS. 3 and 4 show centering devices for the apparatus according to FIG. 1.

The filling material is pressed into the inner space of the cable 18 under a certain pressure. Consequently, it is important that the pressure at the inlet 11, compared with the dimensions of the cable, its inner structure, inlet rapidity and the length of the filling pipe 10 and the width of the gap 19 between the cable and the pipe, is adjusted so that the cable before passage of the inlet 11 is completely filled all the way into the cavities in its center. The flow conditions upon passage of the cable through the filling pipe appear in FIG. 2. The cable 18 is assumed to be transported from left to right through the pipe 10. Vaseline is pressed through the inlet 11 to the annular gap between the cable and the pipe along the whole length of the pipe, arrow 20 indicate the flow direction of excess vaseline. Arrows 21 designate the magnitude and direction of the vaseline flow which is pressed into the cable. Each part of the cable is filled with vaseline slightly to the left of a line through the inlet 11.

Figure 3:
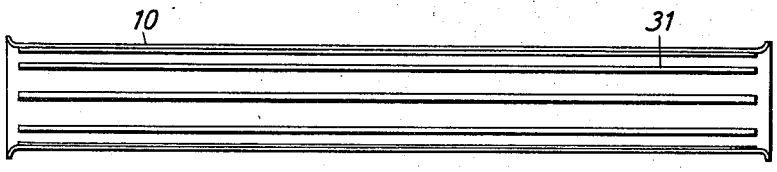
Figure 4:
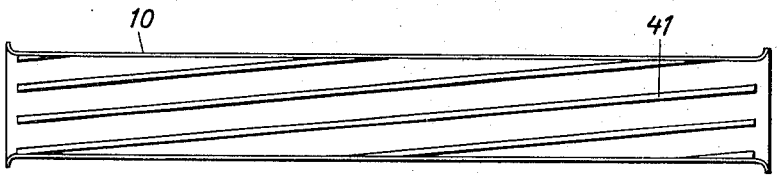
Figure 5:
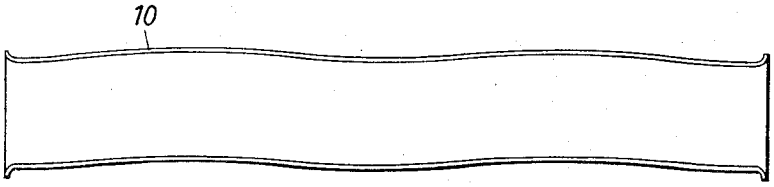
FIG. 5 shows a modification of a filling pipe included in the apparatus according to FIG. 1, FIGS. 6 and 7 show another type of centering device.

For stabilisation of the pressure of the filling material, it is important that the cable is well centered in the filling pipe during the passage of the cable through the pipe. This can be effected by special centering means arranged in the pipe. These means, as indicated in FIG. 3, can consist of guide rails 31 arranged along the inside of the filling pipe 10 parallel with the symmetry axis, or as shown in FIG. 4, can consist of guide rails 44 arranged helically. The centering may also be obtained by forming the filling pipe 10 itself with a helical shape as seen in FIG. 5.

Figure 6:
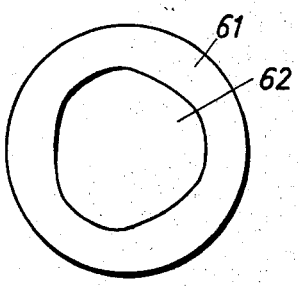
Figure 7:
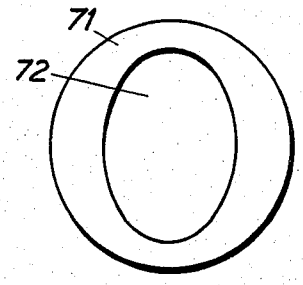

The centering of the cable may also be effected by at least one plate arranged in the filling pipe 10 and provided an opening for a cable. In FIG. 6 there is shown such a plate 61 with an opening 62. As appears from FIG. 6 this opening is non-circular smallest radius of the opening is somewhat less than the radius of the cable and the largest radius of the opening is somewhat larger than the radius of the cable. This not only achieves a centering of the cable, but also a favorable occasional deformation of the body, which facilitates the penetration and distribution of the filling material in the cable. In FIG. 7 there is shown a similar plate 71 with an elliptical opening 72. The plates can be rotatable arranged to facilitate the penetration of the filling material.

Figure 8:
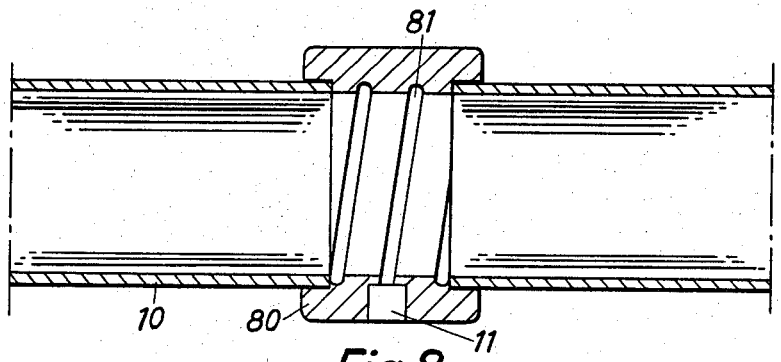
FIG. 8 shows a modified feeding device for the apparatus according to FIG. 1.
Figure 9:
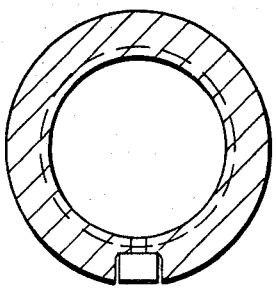
FIG. 9 is a transverse section through the feeding device according to FIG. 8.

One further method of centering the cable in the filling pipe is to form the inlet to the pipe with a ring-shaped chamber 80 with tracks 81 fitting the inner contour of the pipe whereby the filling material achieves a rotating movement. Such a chamber 80 appears in FIGS. 8 and 9, the latter being a section through the inlet 11.

It is suitable that the outside of the cable has a layer of band material, for example non-woven fabric, web fabric, woven or non-woven textile and felt or a net of materials which are permanently resistant to mechanical, chemical, physical and thermal strains which might come about. This band material has four functions, namely to keep the cable together and protect it mechanically in the operations which follow the cabling, to easily let the flowable filling material pass therethrough, and after the filling to prevent runoff of the filling material from the cable to capillary action, and after the impregnation with the filling material to constitute a heat barrier during a following sheathing operation. Such a material can be a non-woven fabric polyester (spunbounded).

We claim:

1. A method of impregnating a cable with water impenetrable and water repellant sealing material, the cable comprising a plurality of conductors having a band thereon which permits inward passage of said sealing material under pressure in flowable form said method comprising passing the cable axially through a pipe having open ends, the pipe and cable forming an annular gap along the length of the pipe which gap is between 1 and 3 mm in thickness and is relatively thin compared to the diameter of the cable, said gap being formed uniformly along the length of the pipe, said gap extending to the open ends of the pipe, heating the sealing material to a temperature to render the same flowable, injecting the heated sealing material under pressure into said pipe at an intermediate position between the open ends thereof to cause part of said sealing material to flow inwardly into said cable while the remainder of the sealing material travels axially along the cable in said gap in opposite directions and freely flows axially outwards from the gap at the ends of the pipe, said sealing material undergoing cooling in the cable to form a barrier against penetration of water.

2. A method as claimed in claim 1 wherein the sealing material is heated to a temperature between 5° C. and 15° C. above the temperature at which the sealing material becomes flowable.

3. A method as claimed in claim 1 comprising mounting an outer enclosure around the pipe through which the cable is passed in sealed relation, and collecting sealing material in said enclosure from both open ends of the pipe for recirculation externally of the enclosure.

4. A method as claimed in claim 1 comprising centering said cable in said pipe by introducing the heated sealing material in a circular rotating flow in said gap.

5. A method as claimed in claim 1 comprising centering said cable in the pipe while concurrently deforming the cable.

6. A method as claimed in claim 1 comprising stabilizing the pressure of the sealing material by centering the cable in the pipe during the passage of the cable through the pipe.

7. A method as claimed lin claim 1 comprising forming said pipe with a non-circular opening whereby said gap is non-uniform throughout the annular extent thereof.

* * * * *